US006137219A

United States Patent [19]

Song et al.

[11] Patent Number: 6,137,219

[45] Date of Patent: Oct. 24, 2000

[54] FIELD EMISSION DISPLAY

[75] Inventors: Yoon Ho Song; Jin Ho Lee, both of Daejeon; Seung Youl Kang, Seoul; Kyoung Ik Cho; Hyung Joun Yoo, both of Daejeon, all of Rep. of Korea

[73] Assignee: Electronics and Telecommunications Research Institute, Daejeon, Rep. of Korea

[21] Appl. No.: 09/122,823

[22] Filed: Jul. 27, 1998

[30] Foreign Application Priority Data

Aug. 13, 1997 [KR] Rep. of Korea ..... 97-38668

[51] Int. Cl.[7] ..... H01J 1/30

[52] U.S. Cl. ..... 313/497; 313/308; 313/336; 313/351; 313/309

[58] Field of Search ..... 313/308, 309, 313/336, 351, 495, 497; 315/169.4

[56] References Cited

U.S. PATENT DOCUMENTS

| | | | |
|---|---|---|---|
| 5,012,153 | 4/1991 | Atkinson et al. | 313/336 X |
| 5,210,472 | 5/1993 | Casper et al. | 315/349 |
| 5,359,256 | 10/1994 | Gray | 313/169 |
| 5,698,942 | 12/1997 | Greene et al. | 313/351 X |
| 5,907,215 | 5/1999 | Mougin et al. | 313/309 X |

OTHER PUBLICATIONS

Ken Ozawa et al., MOSFET–structured Si field emitter tip; Technical Digest of IVMC'97 Kyongiu, Korea, pp 34–37; Dec. 1997.

Gen Hashiguchi et al., A Novel Multi–Layered Device of Polycrystalline Silicon Field Emitters and Thin Film Transistor for Field Emission Displays, IDW96, pp. 159–162.

Hidenori Gamo et al., Amorpous–Silicon–on–Glass Field Emitter Arrays, IEEE Electron Device Letters, vol. 17, Jun. 1996, pp. 261–263.

R. Baptist et al., Microtips and Resistive Sheet: A Theoretical Description of the Emissive Properties of This System; 9th International Vacuum Microelectronics Conference, St. Petersburg; pp. 19–23; Dec. 1996.

S.E. Huq et al., Fabrication of Gated Polycrystalline Silicon Field Emitters, 9th International Vacuum Microelectronics Conference, St. Petersburg; pp. 357–370; Dec. 1996.

*Primary Examiner*—Ashok Patel

*Attorney, Agent, or Firm*—Cohen, Pontani, Lieberman & Pavane

[57] ABSTRACT

A field emission display having an n-channel high voltage thin film transistor is disclosed. According to the present invention, a signal for driving pixels controls by the nHVTFT attached with each pixel, therefore, the signal voltage of row and column drivers is exceedingly decreased. As a result, it is possible to implement a field emission display capable of providing a high quality picture in a low consumption power, a low driving voltage and inexpensive to manufacture, and preventing a line cross talk using the nHVTFT. By using a cylindrical resistive body underlying a cone-shaped emitter tip, the present invention is to provide a field emission display having an excellent contollability and stability of the emission current, and a dynamic driving capability.

13 Claims, 3 Drawing Sheets

FIELD EMISSION DISPLAY

BACKGROUND OF THE INVENTION

1. Field of the Invention

The present invention relates to a field emission display, more particularly to a field emission display having a high voltage thin film transistor.

2. Description of the Prior Art

Field emission displays (FED's) are attracting significant attention because they are promising as a future flat-panel-display. The FED's include a lower plate having field emitter arrays and an upper plate coated with a fluorescent material such as phosphor. The electrons emitted from field emitters of the lower plate come into collision with the fluorescent material of the upper plate, thereby displaying a picture on a screen of the field emission display. This display, which uses a cathode luminescence of the fluorescent material, has been widely developed as a flat panel display which can be substituted for a cathode ray tube (CRT).

FIG. 1 is a schematic view illustrating a configuration of the lower plate in a conventional field emission display.

Referring to FIG. 1, the lower plate of the conventional FED's comprise a plurality of emitter arrays 10P (or pixel arrays) arranged in a matrix type, and a row driver 20P and a column driver 30P for driving each pixel. The row driver 20P and the column driver 30P control a scan signal and a data signal of the display, respectively. Each gate electrode of the emitter arrays 10P is connected to the row driver 20P and each emitter electrode of the emitter arrays 10P is connected to the column driver 30P.

FIG. 2 is a cross sectional view illustrating a conventional field emitter in FIG. 1.

As shown in FIG. 2, the conventional field emitter includes an emitter electrode 102P formed on an insulating substrate 101P, a resistance layer 103P made of an amorphous silicon layer formed on the emitter electrode 102P, cone shaped emitter tips 104P formed on a portion of the resistance layer 103P, and a gate insulating layer 105P and a gate electrode 106P surrounding the emitter tips 104P for applying electric fields to the emitter tips 104P.

The conventional field emission display has an advantage that it easily fabricated on a large glass substrate by using the electron beam evaporation method. However, it is very difficult to fabricate since the row and column drivers 20P and 30P have to supply a driving voltage more than about 50 volts to the gate electrode 106P and the emitter electrode 102P of the field emitter.

That is, because the row and column drivers 20P and 30P have a high voltage tolerance, it requires a high cost equipment and a precise process instead of a popular complementary metal-oxide-semiconductor (CMOS) fabrication technique. Accordingly, the conventional field emission display has a disadvantages that it has a high fabrication cost and a high consumption power.

Additionally, the conventional FED has an disadvantage that a line cross talk is easily caused in case that the emitter tip 104P and the gate electrode 106P are electrically short even at one pixel.

SUMMARY OF THE INVENTION

Accordingly, it is an object of the present invention to provide a field emission display having a low consumption power, a low driving voltage, and inexpensive to manufacture.

Another object of the present invention is to provide an improved field emission display which can prevent a line cross talk.

A further object of the present invention is to provide a field emission display having an excellent contollability and stability of the emission current, and a dynamic driving capability.

In accordance with the present invention, there is provided a field emission display including an upper plate and a lower plate parallel to each other, the lower plate comprising a pixel array arranged in a matrix; and a row driver and a column driver for supplying a scan signal and a data signal, respectively, to drive said pixel array, in which each pixel comprising: a field emitter array, having each gate electrode thereof connected to a common electrode; and an n-channel high voltage thin film transistor (nHVTFT) for controlling emission currents of said emitter array, having a gate electrode electrically connected to said row driver, a source electrode connected to said column driver, and a drain electrode connected to an emitter electrode of said field emitter array.

Preferably, the gate electrodes of the field emitter array are biased to a constant voltage.

Also, the scan signal for applying a voltage to the gate electrode of the nHVTFT is selectively enable row lines of pixel arrays as a pulse signal having a pulse width ($t_s$), and the data signal for applying a voltage to the source of nHVTFT controls an emission of electrons as a pulse signal having a pulse width ($t_d$) when the scan signal is enable, and the pulse width of the scan signal ($t_s$) is more than the pulse width of the data signal ($t_d$).

More preferably, the field emitter array and the nHVTFT are integrated on a single substrate, and the emitter electrode of the field emitter array and the drain of the nHVTFT are made of the same conductive layer.

Also, the field emitter array further comprises cylindrical resist bodies made of undoped silicon underlying cone-shaped emitter tips composed of doped silicon.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be constructed as limiting the invention.

DETAILED DESCRIPTION OF THE PREFERRED EMBODIMENTS

Hereinafter, a field emission display according to the present invention will be described below referring to figures.

Figure 1:
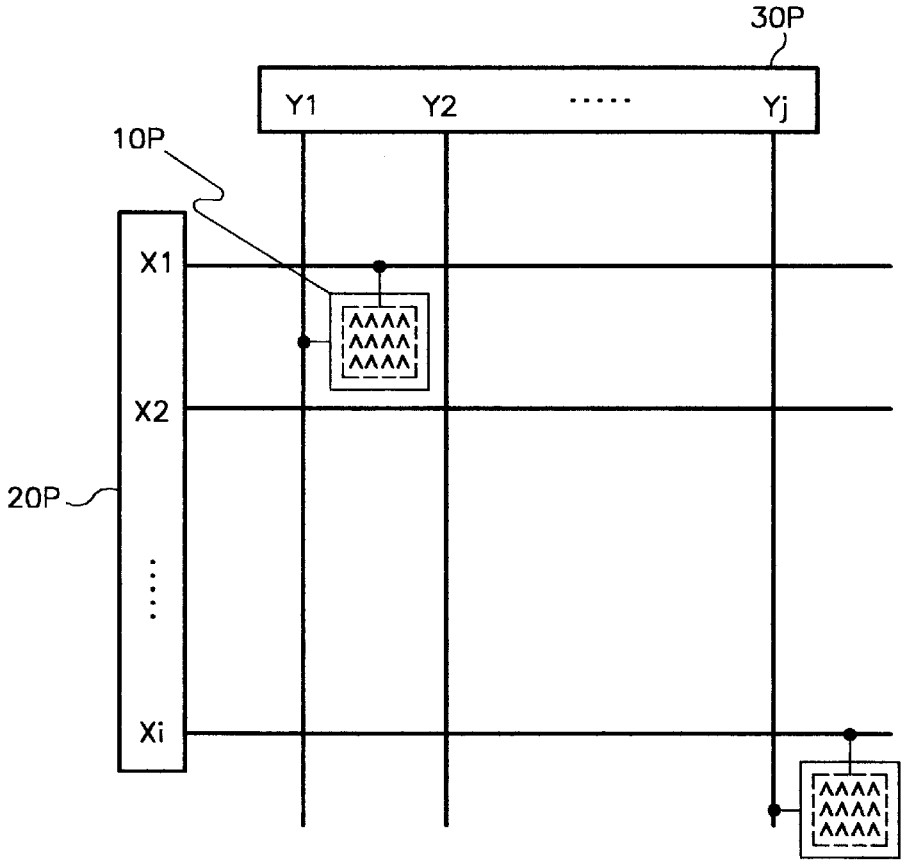
FIG. 1 PRIOR ART
FIG. 1 is a schematic view illustrating a configuration of a lower plate in a conventional field emission display.
Figure 2:
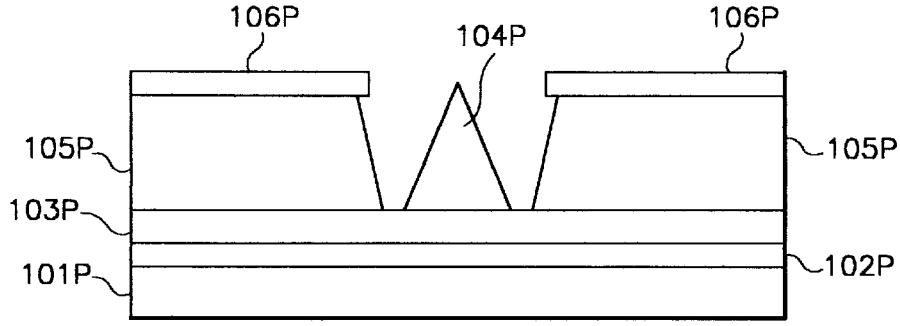
FIG. 2 PRIOR ART
FIG. 2 is a cross-sectional view illustrating the field emitter in FIG. 1.
Figure 3:
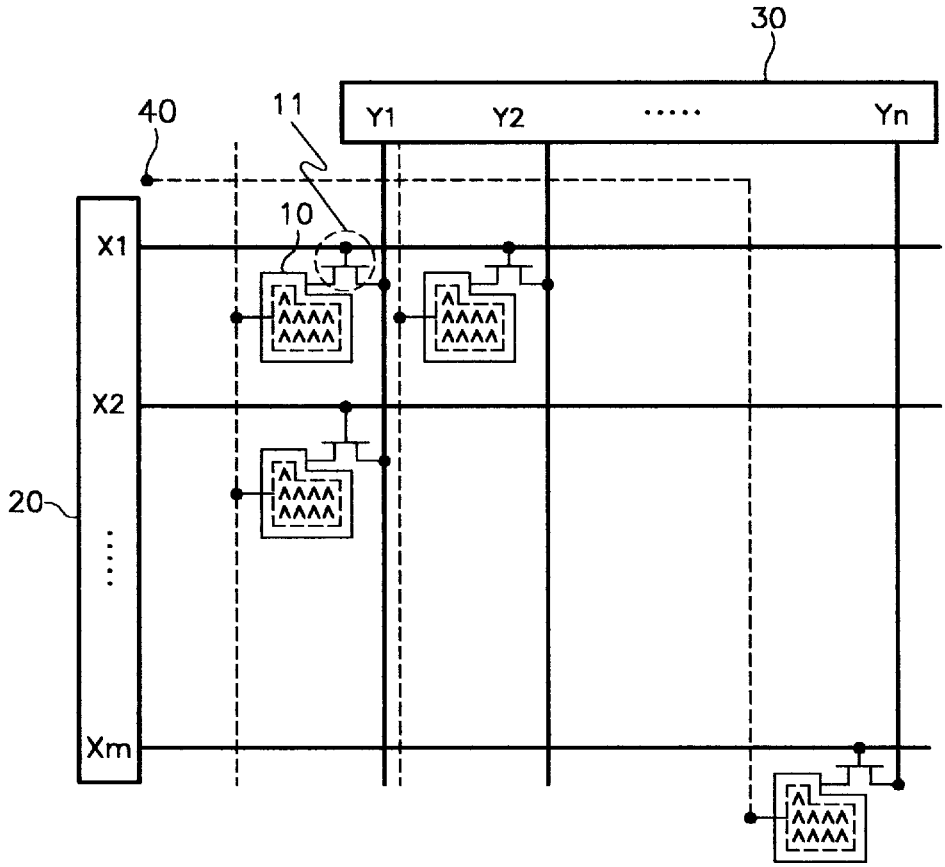
FIG. 3 is a schematic view illustrating a configuration of a lower plate of a field emission display in accordance with the present invention.

FIG. 3 is a schematic view showing a lower plate of FED's according to the preferred embodiment of this invention. As shown in FIG. 3, a plurality of pixel are arranged in a matrix type, and a row driver circuits 20 and a column driver circuits 30 for driving the matrix shaped pixel arrays are located in the periphery of the pixel arrays. The row driver 20 and the column driver 30 generate scan signals and data signals of display, respectively.

Each pixel in the pixel array includes a field emitter arrays 10 and a n-channel high voltage thin film transistor (nHVTFT) 11. The field emitter array 10 and the nHVTFT 11 can be made of a polycrystalline silicon, or amorphous silicon as an active material.

At this time, a gate of the nHVTFT 11 is connected to the row driver 20, a source of the nHVTFT 11 is connected to the column driver 30, and a drain of the nHVTFT 11 is electrically connected to an emitter electrode of the field emitter array 10. Also, a gate electrode of the field emitter array 10 is connected to a common electrode 40.

Figure 4:
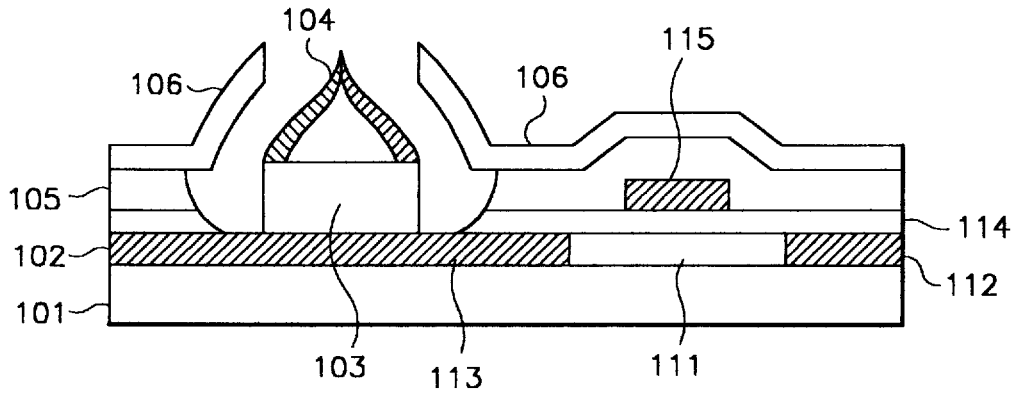
FIG. 4 is a cross-sectional view illustrating a silicon field emitter array and n-channel high voltage thin film transistor (nHVTFT) in accordance with the present invention.

FIG. 4 is a cross-sectional view illustrating a structure of the nHVTFT 11 and the field emitter array 10 for forming a pixel in accordance with the present invention. As shown in FIG. 4, the field emitter array 10 and the nHVTFT 11 are integrated on the same substrate.

The field emitter array 10 includes an emitter electrode 102 formed on an insulating substrate 101 such as an oxide layer, a nitride layer, a quartz substrate, a glass substrate, or the like. The field emitter array 10 is composed of a plurality of emitters, and each emitter consists of a cylindrical resist body 103 and a cone-shaped emitter tip 104 (In FIG. 4, the single emitter is a representative of a plurality of emitters. Also, a cylindrical resist body 103 is formed on the emitter electrode 102 and a cone-shaped silicon field emitter tip 104 is formed on the cylindrical resist body 211. The cylindrical resist body 103 and the silicon field emitter tip 104 are surrounded with a gate oxide layer 105 and a gate 106 for applying an electric field to the cone-shaped silicon emitter tip 104.

At this time, the cylindrical resist body 103 is made of an undoped silicon layer and the entire or a portion of the silicon field emitter tip 104 is made of a doped silicon layer. Since the undoped silicon layer has a high resistivity, the cylindrical resist body itself 103 may serve as a resistor. Also, the gate 106 of field emitter is electrically connected to the common electrode 40 (not shown in FIG. 4).

Meanwhile, the n-channel high voltage thin film transistor (nHVTFT) includes a channel region 111, which is made of an undoped silicon layer formed on the same insulating substrate 101, a source region 112 and a drain region 113, which is made of a doped silicon layer formed at both sides of the channel region 111, a gate insulating layer 114 formed on the channel 111 and the source/drain regions 112 and 113, and a gate electrode 115 formed on a portion of the gate insulating layer 114. Also, the nHVTFT has an off-set structure in which the gate electrode 115 is not overlapped in a perpendicular direction with the drain region 113 and the source region 112 so that it may be operated at a high voltage. Also, the drain region 113 of the nHVTFT and the emitter electrode 102 of the field emitter array can be made of the same conductive layer, and are electrically connected to each other.

The nHVTFT 11 attached with each pixel in the pixel array is a switching device for controlling emission currents of the field emitter array 10 according to the scan signal and data signal applied to the pixel. By using the nHVTFT attached with each pixel, therefore, the signal voltage of the scan and data driver is exceedingly decreased.

Hereinafter, an operating method of the field emitter display according to this invention will be described.

Figure 5:
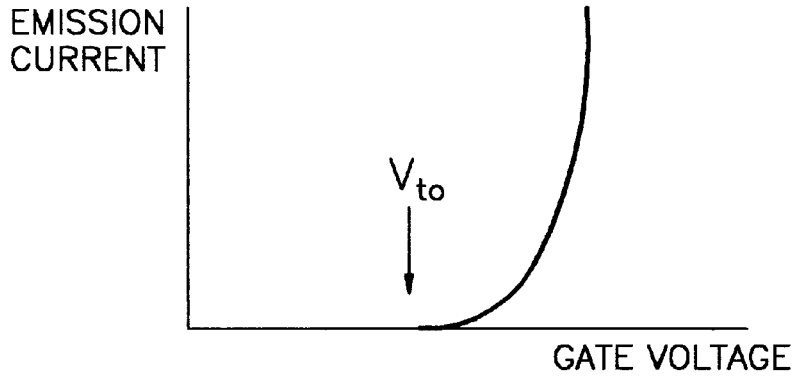
FIG. 5 is a graph illustrating the current-voltage characteristics of the field emitter array in accordance with the present invention.

FIG. 5 is a graph illustrating the current-voltage characteristics of the field emission device. In FIG. 5, the gate voltage indicates the voltage applied to the gate electrode 106 of the field emitter. As shown in FIG. 5, if the gate voltage higher than the turn-on voltage (typically, 50 volts or more) is applied to the gate electrode, electrons are emitted from the emitter tip 104 of the field emitter array.

Figure 6:
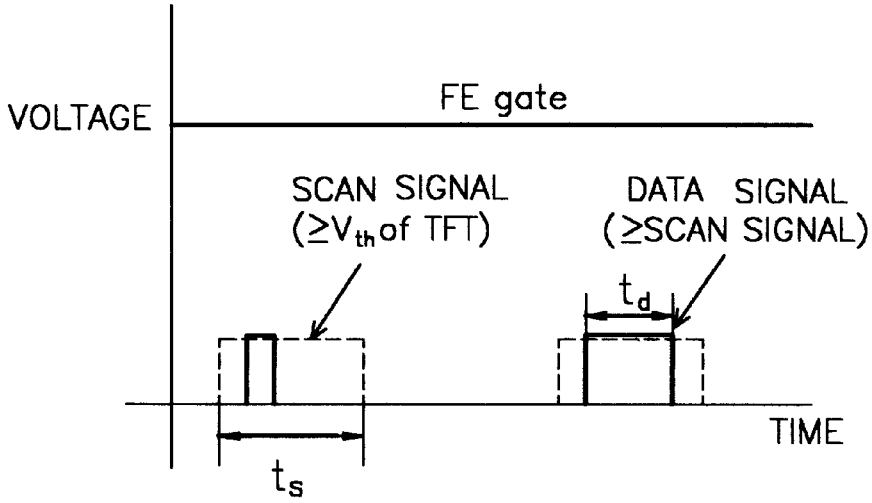
FIG. 6 is a timing chart illustrating a signal voltages for operating a lower plate of the field emission display in accordance with the present invention.

FIG. 6 is a timing chart illustrating a signal voltage for operating a lower plate of the field emission display in accordance with the present invention.

As shown in FIG. 6, an FE gate, which is a voltage applied to the common gate electrodes 40, is maintained at a constant voltage more than the turn-on voltage $V_{to}$ of the field emitter array. The scan signal, which is a voltage applied to the gate electrode 115 of the nHVTFT 11 from the row driver 20, is a threshold voltage of the nHVTFT or more than that thereof ($\geqq V_{th}$). This scan signal selects one row of the pixel array in a pulse signal type (pulse width: $t_s$). Also, the data signal, which is a voltage applied to the source 112 of the nHVTFT 11 through the data wiring from the column driver 30, turns on or off the nHVTFT 11 in a pulse signal type (pulse amplitude: larger than the scan signal), and then controls the electrons' emission when the scan signal is in an on-state.

Accordingly, the effective time for electron emission in pixels is ($t_s$–$t_d$) when a pixel line is selected by the scan signal. In this driving method, a gray level representation of the display is performed by a pulse width modulation (PMW) which is changing the pulse width $t_d$ or pulse number of the data signal. The voltage of the scan and data signals is considerably decreased by controlling the line selection of the display using the high voltage thin-film transistor 11 attached to each pixel.

Additionally, it is possible to easily integrate the field emitter array 10 with the resist body 103 and the nHVTFT 11 on the same substrate, since they can be made of polycrystalline silicon or amorphous silicon. By using a popular processes for forming the field emitter and the thin film transistor, the field emitter display in accordance with this invention is also easily fabricated.

As described above, according to the present invention, a signal for driving pixels controls by an n-channel high voltage thin film transistor (nHVTFT) attached with each pixel, therefore, the signal voltage of the row and column driver is exceedingly decreased. As a result, it is possible to implement a field emission display capable of providing a high quality picture in a low consumption power, a low driving voltage and inexpensive to manufacture. Also, the present invention is to provide an improved field emission display which can prevent a line cross talk using the nHVTFT.

Additionally, by using a cylindrical resistive body underlying a cone-shaped emitter tip, the present invention is to provide a field emission display having an excellent contollability and stability of the emission current, and a dynamic driving capability.

Further, since the field emitter array and the nHVTFT in accordance with the present invention are all fabricated at a low temperature of 600° C. or less, a glass which is low in price and has a large area can be used as an insulating substrate.

Although the preferred embodiment of the present invention has been disclosed for illustrative purpose, those skilled in the art will appreciate that various modifications, additions and substitutions are possible, without departing from the scope and spirit of the invention as disclosed in the accompanying claims.

What is claimed is:

1. A field emission display including an upper plate and a lower plate disposed in parallel relation to each other, the lower plate comprising:

a pixel array containing a plurality of pixels arranged in a matrix;

a row driver and a column driver for supplying a scan signal and a data signal, respectively, to drive said pixel array, each pixel in said pixel array having;

a field emitter array, having a gate electrode, and an emitter electrode, said gate electrode being connected to a common electrode; and an n-channel high voltage thin film transistor (nHVTFT) for controlling emission currents of said field emitter array, said nHVTFT having a gate, a source and a drain terminal, wherein said gate electrode is electrically connected to said row driver, said source electrode is connected to said column driver, and said drain electrode is connected to said emitter electrode of said field emitter array.

2. The field emission display in accordance with claim 1, wherein said field emitter has a turn-on voltage and wherein a constant voltage greater than said turn-on voltage is applied to said common electrode.

3. The field emission display in accordance with claim 1, wherein a scan signal for applying a voltage to the gate electrode of the nHVTFT is used as a pulse signal having a pulse width ($t_s$) to selectively enable row lines of pixel arrays.

4. The field emission display according to claim 1, wherein said data signal for applying a voltage to the source terminals of nHVTFT is a pulse signal having a pulse width ($t_d$) when said scan signal is enabled for controlling an emission of electrons.

5. The field emission display according to claim 4, wherein said pulse amplitude of the data signal ($t_d$) is more than the pulse amplitude of the scan signal ($t_s$).

6. The field emission display according to claim 1, wherein said field emitter array and said nHVTFT are integrated on a single substrate.

7. The field emission display according to claim 1, wherein said emitter electrode of the field emitter array and said drain of the nHVTFT are made of the same conductive layer.

8. The field emission display according to claim 1, wherein said field emitter array is made of a polycrystalline silicon field emitter, and said nHVTFT is composed of a polycrystalline TFT.

9. The field emission display according to claim 1, wherein said field emitter array and said nHVTFT are composed of an amorphous silicon field emitter and an amorphous silicon TFT, respectively.

10. The field emission display according to claim 1, wherein said field emitter array further comprising cylindrical resist bodies underlying cone-shaped emitter tips.

11. The field emission display according to claim 10, wherein said cylindrical resist body is made of undoped silicon.

12. The field emission display according to claim 10, wherein said cone-shaped emitter tip is composed of doped silicon.

13. The field emission display according to claim 1, wherein a gray level representation of the display is performed by changing the pulse width ($t_d$) of the data signal.

* * * * *